US005655895A

United States Patent [19]

Warth et al.

[11] Patent Number: 5,655,895

[45] Date of Patent: Aug. 12, 1997

[54] TURBOPUMP FOR CONVEYING HIGHLY VISCOUS SUBSTANCES

[75] Inventors: Helmut Warth, Ludwigshafen, Germany; Bernard Josserand, Sillingy, France; Robert Bariatti, Annecy, France; Jean Rougeaux, Seynod, France; Sylvain Stihle, Bluffy, France

[73] Assignee: KSB Aktiengesellschaft, Frankenthal, Germany

[21] Appl. No.: 481,450

[22] PCT Filed: Nov. 12, 1993

[86] PCT No.: PCT/EP93/03178

§ 371 Date: Jun. 19, 1995

§ 102(e) Date: Jun. 19, 1995

[87] PCT Pub. No.: WO94/15065

PCT Pub. Date: Jul. 7, 1994

[30] Foreign Application Priority Data

Dec. 19, 1992 [DE] Germany ..... 42 43 132.8

[51] Int. Cl.[6] ..... E21B 43/12; E21B 43/40; F04D 13/04

[52] U.S. Cl. ..... 417/391; 417/405

[58] Field of Search ..... 417/376, 391, 417/405, 406

[56] References Cited

U.S. PATENT DOCUMENTS

| | | | |
|---|---|---|---|
| 1,610,454 | 12/1926 | Lawaczeck | 417/365 |
| 3,219,483 | 11/1965 | Goos et al. . | |
| 3,981,626 | 9/1976 | Onal | 417/405 |
| 4,019,720 | 4/1977 | Levesque et al. . | |
| 4,056,335 | 11/1977 | Secrist . | |
| 4,086,030 | 4/1978 | David . | |
| 4,573,803 | 3/1986 | Gritter et al. . | |
| 4,721,436 | 1/1988 | Lepert | 417/391 |
| 4,749,034 | 6/1988 | Vandevier et al. . | |
| 5,033,545 | 7/1991 | Sudol . | |
| 5,176,448 | 1/1993 | King et al. . | |
| 5,320,500 | 6/1994 | Cholet | 417/405 |

FOREIGN PATENT DOCUMENTS

| | | |
|---|---|---|
| 0 246943 | 4/1987 | European Pat. Off. . |
| 0 322958 | 12/1988 | European Pat. Off. . |
| 0 402567 | 2/1990 | European Pat. Off. . |
| 2 656035 | 12/1989 | France . |
| 2 057058 | 8/1980 | United Kingdom . |
| 2 166472 | 10/1985 | United Kingdom . |

*Primary Examiner*—Michael Koczo
*Attorney, Agent, or Firm*—Darby & Darby

[57] ABSTRACT

A turbopump pumps a fluid of high viscosity. The pump has an inlet and an outlet. The pump is disposed on a shaft. A turbine has a separate inlet and a separate outlet from those of the pump. The turbine is disposed on the same shaft as the pump. A vehicle liquid has a viscosity less than that of the fluid and is miscible with the fluid. The vehicle liquid is conducted under pressure to the inlet of the turbine, such that a portion of the partially pressure-relieved vehicle liquid exits from the turbine as solvent liquid and is admixed to the fluid in a chamber disposed before the inlet to the pump. Thus, the viscosity of the mixture is reduced. Such that the mixture of solvent liquid and fluid is suctioned from the inlet of the pump. A plurality of injection channels are disposed in the chamber. The solvent liquid is conducted through the injection channels with both a radial and tangential component with respect to the flow of the fluid in the chamber so as to create an angular momentum in the fluid in the chamber.

6 Claims, 6 Drawing Sheets

TURBOPUMP FOR CONVEYING HIGHLY VISCOUS SUBSTANCES

BACKGROUND OF THE INVENTION

1. Field of the Invention

The present invention relates to a turbopump for conveying highly viscous substances, especially heavy hydrocarbons or petroleum, in which a liquid of low viscosity is mixed with the more viscous fluid being conveyed, in order to reduce the viscosity of the conveyed medium before entry into the pump. For this purpose, the turbopump comprises a pump with an inlet and an outlet, also a turbine with an inlet and an outlet, which are different from those of the pump, and which are fastened on the same shaft as the pump. In this turbopump, a vehicle fluid with a viscosity lower than that of the fluid that is miscible therewith is conducted under pressure to the inlet of the turbine. A portion of the vehicle fluid coming from the turbine as the solvent fluid, partially relieved of pressure, is admixed to the fluid in a chamber before entry into the pump, and thus the viscosity of the mixture is reduced. The mixture of solvent liquid and fluid is suctioned at the entry of the pump.

2. Description of the Related Art

A large proportion of the world oil reserves consists of heavy, viscous petroleum. As light petroleum is increasingly being exhausted, there exists a need for technologies to convey the heavy petroleum. Various methods for reducing the viscosity of petroleum have been developed in order to recover this petroleum, so that the petroleum can be conveyed with a pump that is in itself well known.

The GB-A-2 166 472 describes a method with a water jet pump and liquefying additives. However, it is pointed out that there is a risk of cavitation damage when this conveyance principle is used. This risk increases as the pressure of the pump increases and thus limits its field of application.

The references EP-A-0 322 958 and U.S. Pat. No. 4,749,034 describe the use of electrically driven pumps in a bore hole with an additional infeed of a solvent liquid and admixture thereof with the conveyed medium. However, electrically driven pumps have the disadvantage that they are unsuited for conveying highly viscous substances, since they tend to develop a large quantity of heat. The solution given for this in the EP-A-0 322 958 encounters its limits, however, if e.g. steam is used to heat the petroleum field. In addition, the cables for the electric motor are also sensitive to temperature.

The U.S. Pat. No. 4,056,335 describes the use of sucker rod pumps with simultaneous infeed of a solvent liquid. This is also an apparatus for recovering heavy petroleum, which reduces the viscosity of the fluid. However, sucker rod pumps can be operated only in vertical bore holes, and do not allow a horizontal orientation of the pump, such as is advantageous especially when conveying highly viscous petroleum.

The disadvantages listed here can be avoided by using a turbopump. These pumps are characterized by the pump being driven by a turbine which is seated on one shaft with the pump. The vehicle liquid in the turbine is wholly or partly admixed to the fluid.

The reference U.S. Pat. No. 4,086,030 relates to a turbopump and discloses an admixture of the vehicle liquid exiting from the turbine with the fluid exiting from the pump. This admixture takes place in a Venturi nozzle, such that the fluid surrounds the vehicle liquid exiting from a nozzle. This has a disadvantage that the admixture occurs only after the outlet from the pump. The viscosity of the mixture is not reduced before entry into the pump.

With the GB-A-2 057 058, the fluid is indeed admixed about a central jet of partially pressure-relieved vehicle medium of a turbine. However, the admixture of the two streams takes place before entry into the pump. This design is indeed especially suitable for conveying low-viscosity medium which contain gas, and to this extent shows that the viscosity of the conveyed mixture can be increased by the vehicle liquid. It is therefore unsuited for use as a turbopump to convey highly viscous media.

The EP-B-0 246 943, on the other hand, discloses a turbopump for conveying highly viscous substances. A component stream of the vehicle liquid is here conducted to the conveyed medium before entry into the pump chamber, with the objective of reducing the viscosity of the pump mixture. However, because of the annular infeed, the vehicle liquid is only partially mixed with the fluid.

The FR-A-2 656 035 also makes use of a process in which the vehicle liquid is fed into the fluid. It is especially suited for operating the pump in a horizontal position. However, it has the disadvantage that the highly viscous fluid is not conducted around the pump until the housing, before the vehicle liquid is admixed and the viscosity is thus reduced.

All previously known pumps consequently have significant disadvantages, which are undesirable for conveying viscous petroleum from deep bore holes which can also terminate in a horizontal position.

SUMMARY OF THE INVENTION

This invention relates to the introduction of a solvent liquid of low viscosity, which serves as the vehicle liquid for a turbopump, to a fluid of high viscosity that is being conveyed, with the objective of reducing the high viscosity of the fluid, of improving the pumpability of the fluid, and of increasing the yield of conveyed fluid. In this process, the solvent liquid is first used to drive the pump by means of the turbine, which is mounted on the same shaft, before all of it or a component stream thereof is conducted, partially relieved of pressure, to the fluid before entry into the pump.

Starting from the turbopump described in the EP-B-0 246 943, of the construction type described above, the conveyance properties are improved by the presence of injection channels in the chamber, through which the solvent liquid is fed with a radial as well as with a tangential component in order to create an angular momentum.

The directed infeed of the solvent liquid creates an angular momentum and causes mixing due to vortex action. The viscosity of the fluid is thus effectively reduced in the inlet section of the pump, and the conveyance power of the pump is increased. While the drive power remains the same, the conveyance output increases, or else the same output can be achieved with a lesser driving power. Besides allowing a saving as regards the turbopump in itself, the diameter of the bore hole thus can concomitantly also be reduced with this method. This is all the more significant as the bore hole is deeper, since the ratio of bore hole costs to machine costs increases strongly with the depth of the bore hole.

The injection channels being directed to the conveyance direction increases the vortex action of the content of the chamber, by means of a counter-flow, and thus promotes mixing.

The injection channels being directed with the conveyance direction additionally speeds up the mixture through the infeed, and the drive power thus can be reduced. Lesser mixing than is obtained in accordance with the teaching described in the counter conveyance direction must be accepted here.

A moisture chamber has nozzles in the chamber wall to infeed the partially pressure-relieved liquid from the chamber walls.

The injection channels are disposed proximate to the axis to infeed the solvent liquid from the middle of the chamber, directed away from the inlet to the pump. This has the advantage that the bearing housing for the pump and turbine shaft can be used as the infeed point. As a rule, the shaft is mounted in a radial slide bearing lubricated with liquid. Consequently, the infeed of liquid through the bearing housing to the bearing already exists, and can be used for injection into the chamber.

The injection channels are disposed in through holes of the bearing housing to infeed the mixture directly into the passages penetrating the bearing housing of the pump and turbine shaft. Since the cross section is reduced at these points, more intense mixing can be achieved. Also, if there are several bearings, additional infeed can take place at more bearings. The bearings divide the multi-stage pump into various sections, which must be designed in accordance with the amount of solvent liquid that is being fed in. The admixture of liquid when using liquid-lubricated slide bearings must also be mentioned. The leakage stream here can assume an non-negligible portion of the conveyance quantity of a turbopump.

The shaft is partially drilled hollow and has a hole through which the solvent liquid is fed to provide for the infeed of solvent liquid. Since the shaft rotates, a dynamic infeed occurs. The directional components of the velocity of the exiting jet are thus superposed by the angular velocity of the shaft at the exit point. The solvent liquid flows over the shaft, which is partially hollowed out by its holes, from the front side of the shaft to the hole.

A mechanical mixer is disposed before the pump inlet and after the injection nozzles so that the first mixing process through directed infeed can be followed by a second, mechanical mixing process with a static mixer or with a dynamic mixer mounted on the shaft, before the mixture finally enters the pump. Because of its design, the mechanical mixer represents an obstacle to the flow in the main flow direction. As the stream flows around the obstacles, vortices are created, and further mixing occurs.

BRIEF DESCRIPTION OF THE DRAWING

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
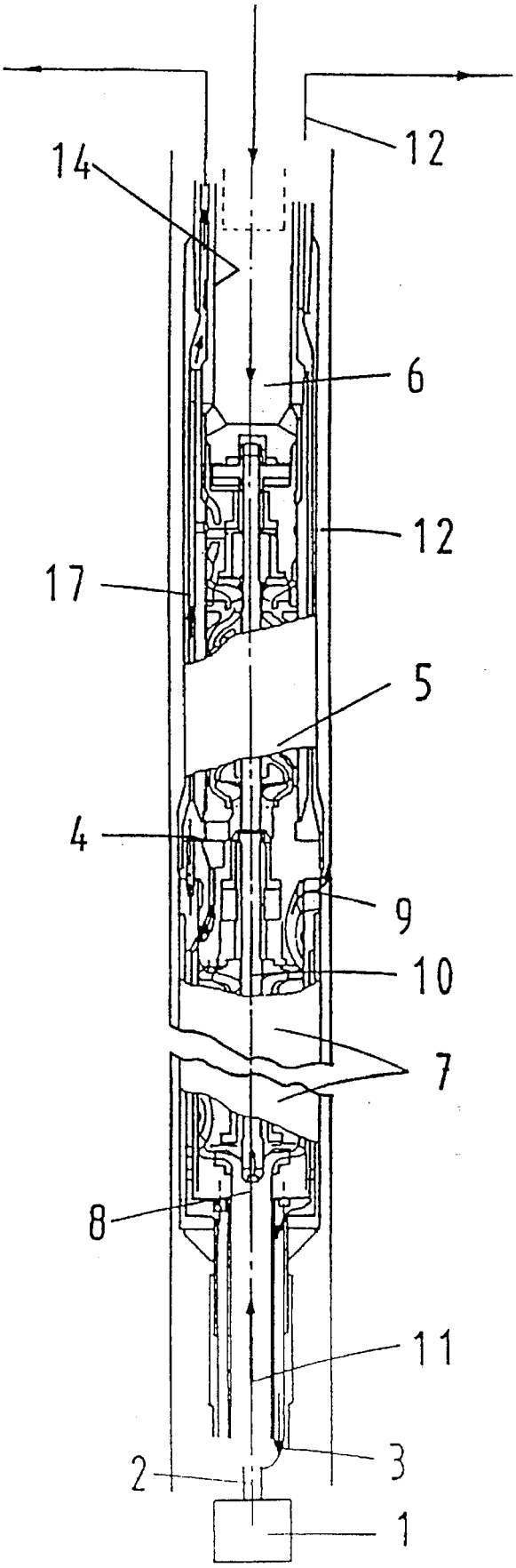
FIG. 1 shows a section through a conventional turbopump.

Fluid of high viscosity exits from a source 1 through an infeed 2. A duct 3 terminates in the infeed 2, and originates from the outlet 4 of a turbine 5 of a turbopump. This machine essentially comprises the turbine 5, which has an outlet 4 and an inlet 6, also a pump 7 with an inlet 8 and an outlet 9, which is fastened on the same shaft 10 as the turbine 5. The patent specification EP-B-0 246 943 describes this turbopump in more detail and the disclosure of which is hereby incorporated by reference.

Figure 2:
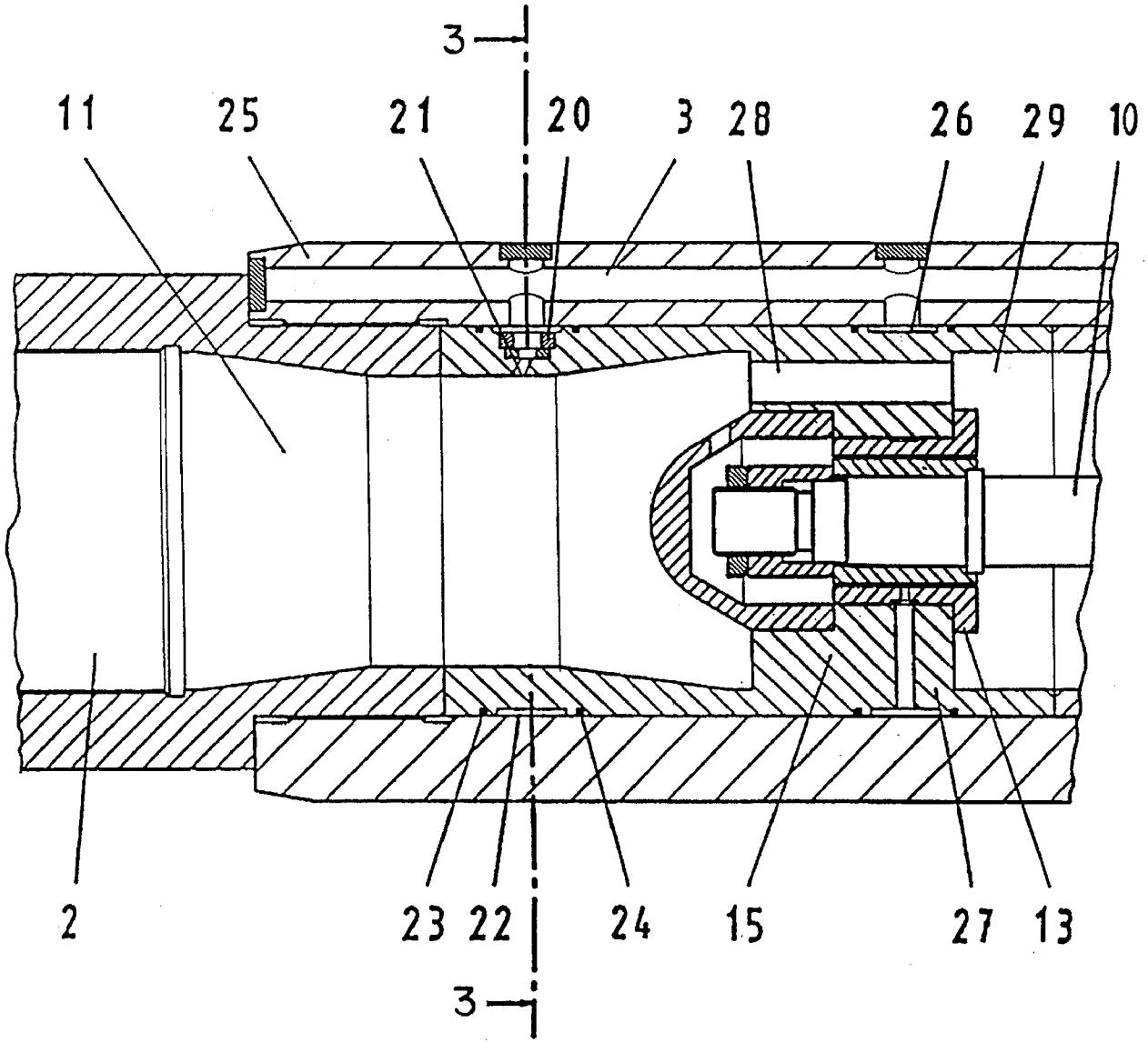
FIG. 2 shows an inventive design for injecting the solvent liquid into the mixing chamber.
Figure 3:
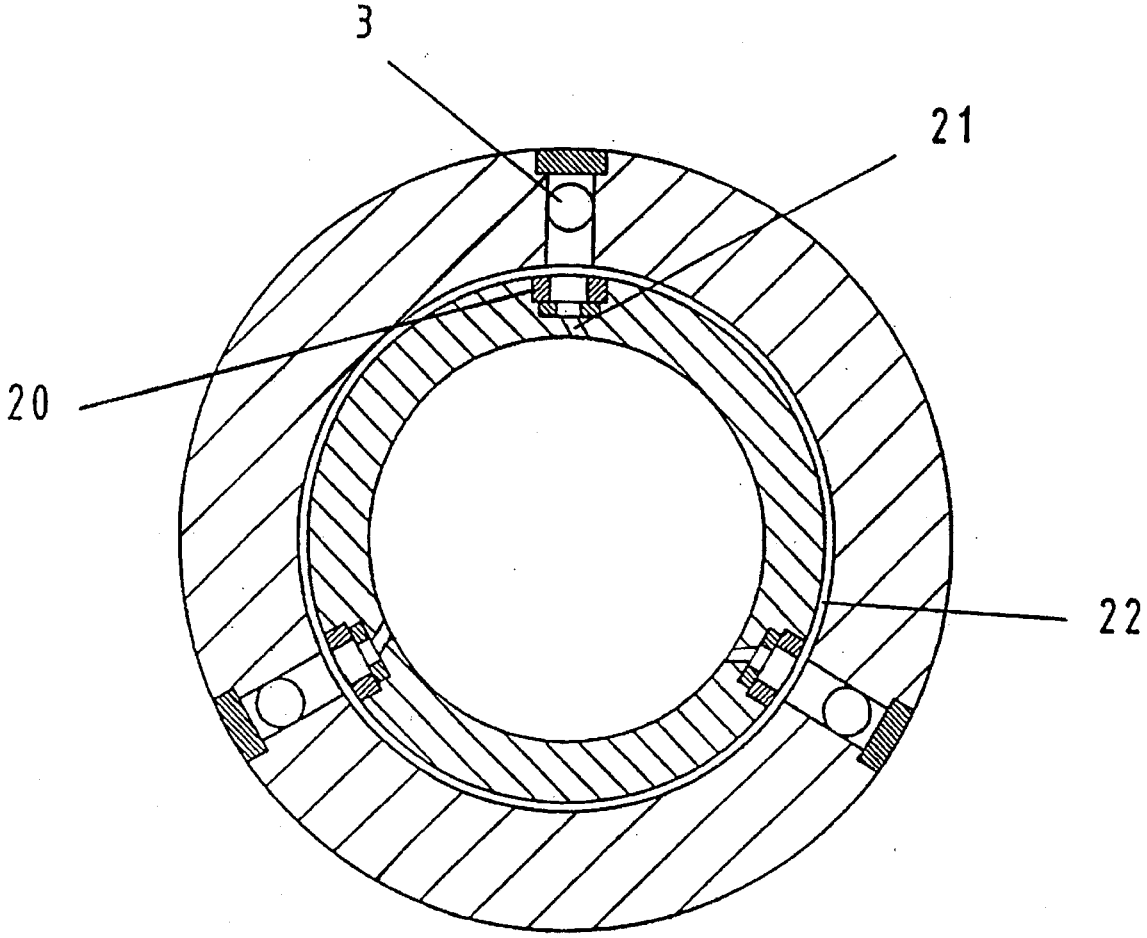
FIG. 3 is a sectional view, taken along line 3—3 in FIG. 2 and looking in the direction of the arrows, and shows the arrangement of the injection nozzles to create an angular momentum.

The turbine 5 is driven by a liquid of low viscosity, which is miscible with the fluid being conveyed. The vehicle liquid is conducted through the inlet 6 of the turbine 5 via the duct 14. One component stream exiting from the outlet 4 from the turbine 5 does not flow to the inlet 8 of the pump 7; it is recycled through the duct 17. The other component stream, designated below as the solvent liquid, is conducted through the duct 3 before the inlet 8 of the pump 7. As shown in FIGS. 2 and 3, it is injected into the infeed 2 while being directed through the nozzles 20 and injection channels 21. The mixture of highly viscous fluids and less viscous solvent liquid passes through an infeed 11 into the inlet 8 of the pump 7. In the infeed 11, the mechanical mixer can mix the mixture additionally before entry into the pump 7. The pump 7 conveys the mixture from the bore hole through the duct 12 that is connected to the outlet 9.

FIG. 2 shows an example of an arrangement of the injection channels 21 in the region of the infeed 2. The injection direction has a component counter to the conveyance direction. A circumferential annular channel 22, sealed by the flexible gaskets 23, 24, makes it possible to affix several nozzles 20, distributed over the circumference. The nozzles 20 are formed of a drilled channel 21 with a small cross section. They are fed through the circumferential annular channel 22, into which flows the partially pressure-relieved solvent liquid.

The modular structure of the turbopump can be seen clearly. The inlet 2 is inserted into the housing 25, whose lower end has the hole 3. The bearing housing 15, with the bearing 13 for the pump- and turbine-shaft 10, is connected to the infeed 2. Grooves 22 or 26 are machined into the bearing housing 15, and are sealed against the housing 25. A chamber 11 forms before the bearing housing 15. Webs 27 and through-passages 28 are situated at the point where the shaft 16 is mounted. Another chamber 29 is situated behind this. A mechanical mixer can be accommodated in this chamber, or the inlet 8 of the pump 7 can connect directly to this chamber.

FIG. 3 shows the position of the nozzles. This figure also shows a tangential component of the injection. This arrangement creates a rotational flow. Also taking account the axial component, this flow has a three-dimensional, helical pattern.

Figure 4:
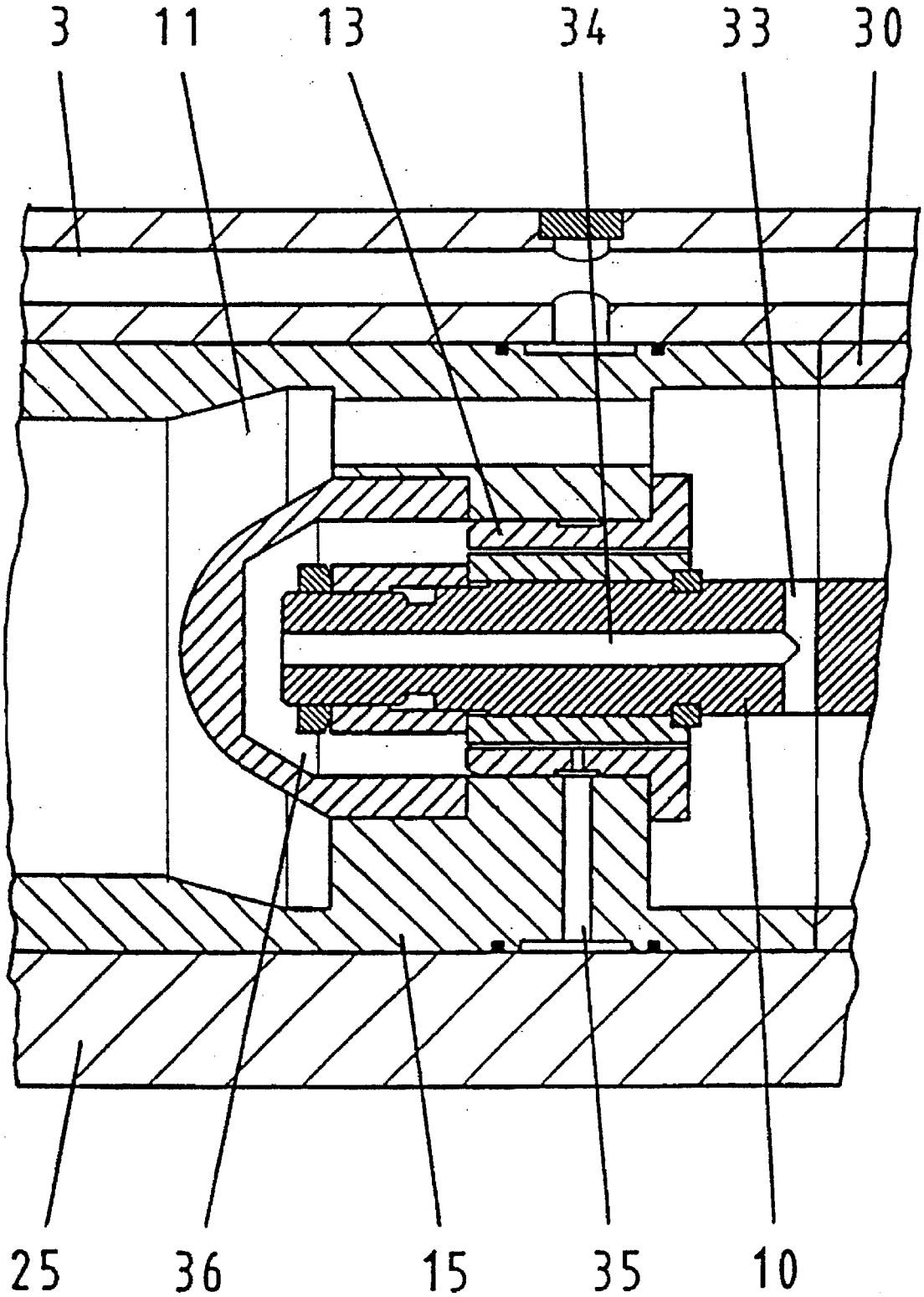
FIG. 4 shows the mechanical mixer as a module of the turbopump.

FIG. 4 shows the modular structure of the turbopump. It shows a mixer 30 disposed after the point at which the vehicle liquid is introduced and preceding the inlet 8 of the pump 7. The shear stresses caused by the mixer increase the mixing of the mixture.

Figure 5:
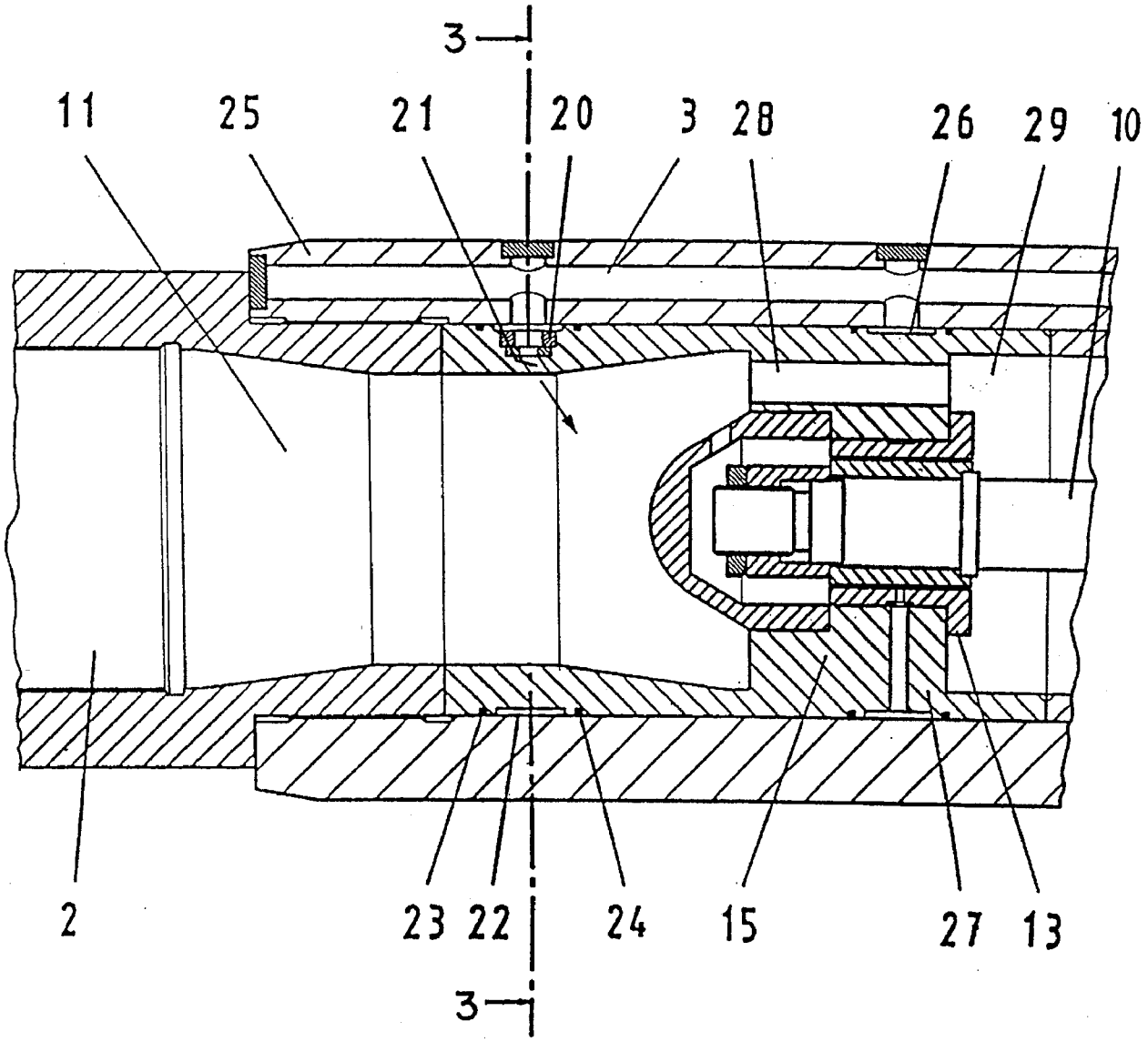
FIG. 5 shows an inventive design for injecting solvent liquid into the mixing chamber.

FIG. 5 shows channel 21 having a component directed toward the inlet to the pump.

Figure 6:
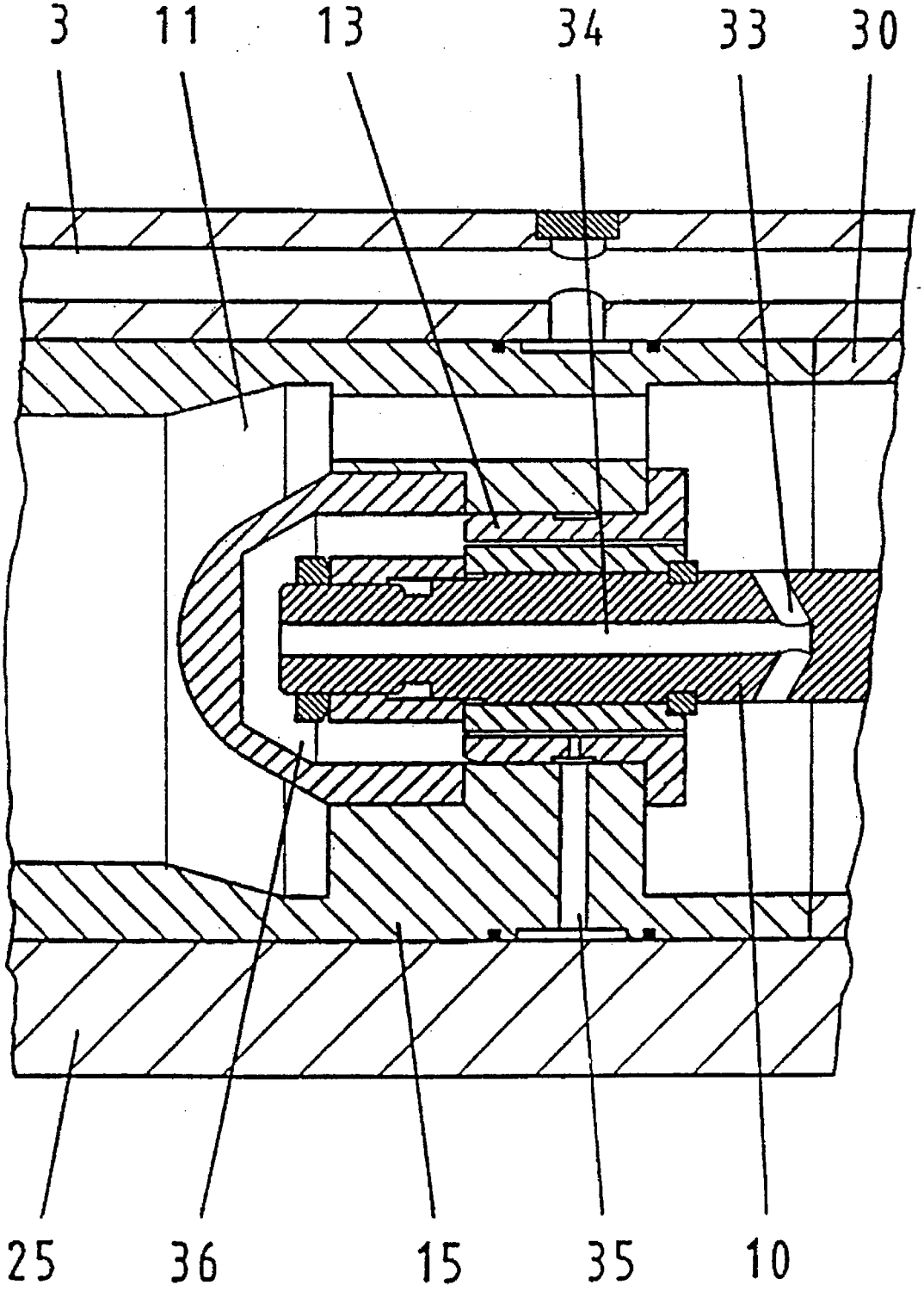
FIG. 6 shows the injection channels disposed proximate to the axis, directing solvent liquid away from the inlet to the pump.

FIG. 6 shows hole 33 disposed proximate to the axis to infeed the solvent liquid from the middle of the chamber directed away from the inlet to the pump.

The solvent liquid is introduced through a hole 33 in the shaft 10. The shaft 10 has a blind hole 34, and is charged with solvent liquid through the cavity 36. The vehicle liquid can flow into the cavity 36 between the bearing 13 and the shaft 10, the bearing being fed through a hole 35 in the bearing housing 15, or it can flow in through additional holes. In other words, the solvent liquid is conveyed from duct 3, through hole 35, through the axial passageway about bearing 13, into cavity 36, through hole 34, through hole 33 and into the chamber in which mixer 30 is disposed.

The present invention makes it possible to develop petroleum deposits with viscous petroleum more economically than the methods and apparatuses used previously.

Having described the presently preferred exemplary embodiment of apparatus and method for forming, filling and sealing a bag in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A turbopump for pumping a fluid of high viscosity, comprising:

a pump having an inlet and an outlet, the pump being disposed on a shaft;

a turbine having a separate inlet and a separate outlet from the pump inlet and outlet, said turbine being disposed on the same shaft as the pump, a vehicle liquid having a viscosity less than that of the fluid and miscible with the fluid is conducted under pressure to the inlet of the turbine, such that a portion of the partially pressure-relieved vehicle liquid exits from the turbine as solvent liquid and is admixed to the fluid in a chamber disposed upstream of the inlet to the pump, and thus the viscosity of the mixture is reduced such that the mixture of solvent liquid and fluid is suctioned from the inlet of the pump, the chamber having an axis and an outer peripheral wall, said fluid flowing substantially axially; and a plurality of injection channels are disposed in the chamber, the solvent liquid being conducted through said injection channels with both a radial component with respect to the flow of the fluid and a tangential component with respect to the outer peripheral wall of the chamber so as to create an angular momentum.

2. The turbopump of claim 1, wherein the direction of the injection channels has a component directed away from the inlet to the pump.

3. The turbopump of claim 1, wherein the direction of the injection channels has a component directed toward the inlet to the pump.

4. The turbopump of claim 1, wherein the injection channels are disposed proximate to the axis, and wherein the injection channels have a component directed away from the inlet to the pump.

5. The turbopump of claim 1, wherein the injection channels are disposed in the vicinity of the axis, and wherein the injection channels have a component directed away from the inlet to the pump.

6. The turbopump of claim 1, wherein the shaft is partially hollow and has a hole through which the solvent liquid is fed into the fluid.

* * * * *